US005461972A

United States Patent [19]

Tähkänen

[11] Patent Number: 5,461,972

[45] Date of Patent: Oct. 31, 1995

[54] DEVICE FOR HANDLING RECYCLING PACKAGES, SUCH AS BOTTLES AND CANS

[75] Inventor: Pekka Tähkänen, Heinola, Finland

[73] Assignee: Halton System Oy, Heinola, Finland

[21] Appl. No.: 198,627

[22] Filed: Feb. 18, 1994

[30] Foreign Application Priority Data

Feb. 18, 1993 [FI] Finland ..... 930729

[51] Int. Cl.[6] ..... B30B 9/32

[52] U.S. Cl. ..... 100/45; 100/49; 100/91; 100/99; 100/137; 100/902; 194/209

[58] Field of Search ..... 100/91, 137, 156, 100/172, 173, 176, 193, 902, 45, 49, 99; 194/208, 209, 213

[56] References Cited

U.S. PATENT DOCUMENTS

| | | | |
|---|---|---|---|
| Re. 27,643 | 5/1973 | Myers | 100/902 |
| 4,245,731 | 1/1981 | Herbst et al. . | |
| 4,248,389 | 2/1981 | Thompson et al. | 241/101.5 |
| 4,345,679 | 8/1982 | DeWoolfson | 100/902 |
| 4,463,844 | 8/1984 | Huffman et al. | 194/213 |
| 4,558,212 | 12/1985 | Hampson | 235/383 |
| 4,919,274 | 4/1990 | Hammond | 209/583 |
| 5,152,387 | 10/1992 | Hammond | 194/208 |

FOREIGN PATENT DOCUMENTS

| | | |
|---|---|---|
| 0082735 | 6/1983 | European Pat. Off. . |
| 0389735 | 10/1990 | European Pat. Off. . |

*Primary Examiner*—Stephen F. Gerrity
*Attorney, Agent, or Firm*—Steinberg, Raskin & Davidson

[57] ABSTRACT

Method and device for handling recycling packages, such as bottles and cans in which a recycling package is introduced into a receiving space in the device and is transferred by a conveyor device into an identification position. After the identification of the package, the recycling package is transferred to a crusher device for crushing the package and then the crushed package is transferred to a storage container. The conveyor device includes a conveyor having lifting members fixed thereto and which contact the recycling package in the receiving space. The package is lifted by the lifting members to the identification position.

21 Claims, 9 Drawing Sheets

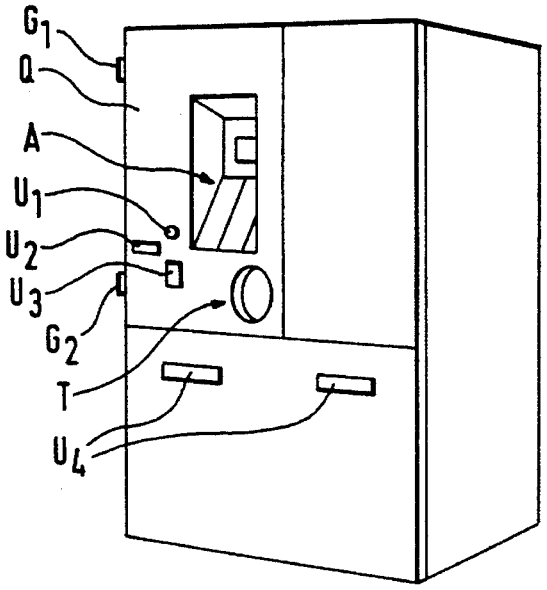
Fig. 1A
Fig. 1C
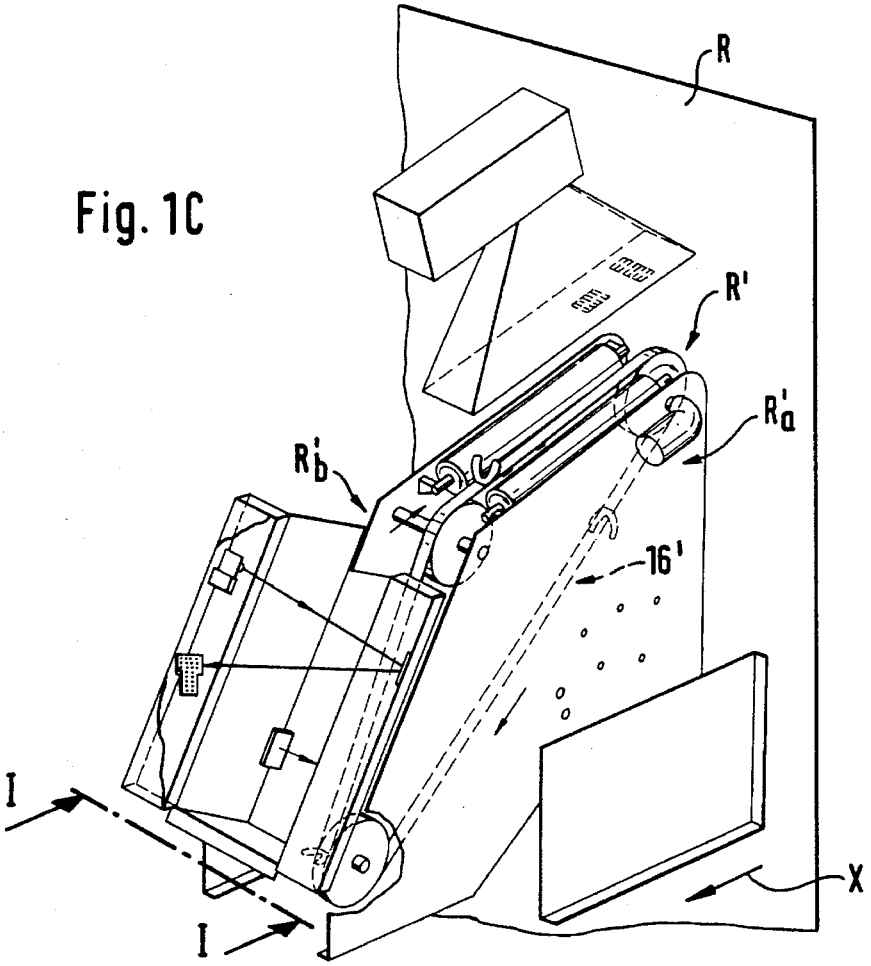

H
10

K3
20a
17a
IV
18a
19
20b
M2
12
19
K2
18c
13a
13
17c
16'
R'
13c
13b
14
A
IV
11
16
26
18b
17b

DEVICE FOR HANDLING RECYCLING PACKAGES, SUCH AS BOTTLES AND CANS

BACKGROUND OF THE INVENTION

The present invention relates to a method and device for handling recycling packages, such as bottles and cans.

In the prior art, devices for handling recyclable or returnable packages, also referred to as return automats, are known in which a recyclable bottle or can is passed into connection with a scanning reader device which reads the code label or bar code placed on the face of the product and, on the basis of the scanned code, identifies the product and transfers the product to further processing/rejection. The prior art devices have, however, not permitted a versatile acceptance of recycling packages. Generally, the return automats have been designed for only one recycling product, either recyclable cans or recyclable plastic bottles.

OBJECTS AND SUMMARY OF THE INVENTION

It is an object of the present invention to provide a new and improved method and device for handling both recyclable plastic containers and metal containers in the same unit.

It is another object of the present invention to provide a new and improved method and device for handling recyclable plastic containers and metal containers in which the containers are transferred by means of improved lifting members from a receiving space to an identification system to be identified.

It is yet another object of the invention to provide a novel method and device wherein the above-mentioned problem related to the prior art devices has been substantially overcome and which permits a versatile acceptance of recycling packages.

In the device in accordance with the present invention, both recycling cans and recycling bottles are received and processed. The recyclable cans are passed to a crusher device of their own, preferably a press, which presses the can into a smaller volume. In a corresponding manner, the plastic bottles are passed to a crusher device of their own, separate from the can crusher device, which presses the plastic bottles into a smaller volume. The recycling packages that have been brought into a smaller volume, i.e., compressed or crushed, are transferred further into storage facilities.

The device in accordance with the present invention, i.e., a return automat, receives recycling packages, preferably plastic bottles and cans, and comprises a frame construction have a front panel and a receiving opening in the front panel. The recycling package, such as a bottle or a can or other plastic and metal containers, is placed into the receiving opening which leads to a receiving space in the device. The receiving space comprises an oblique inclined bottom onto which the recycling package is placed. The recycling package is guided by the inclined bottom and is positioned against the end wall of the space by the force of gravity.

In the device in accordance with the invention, the bottom part is linked so as to pivot on hinge means and, if the weight of the recycling package exceeds a certain maximum weight, a limit switch is switched on. In this case, the device does not transfer the recycling package further but, e.g., rejects the can. In this way, the processing of full packages is substantially eliminated. In the device, a photocell detects a recycling package when it is in a lifting position ready to be transferred to an identification position. Moreover, a light curtain is placed at the mouth of the receiving space. When the light curtain does not detect an object or obstacle in the receiving space, such as the hand of the person who is returning the package, and when the press switch connected with the bottom part of the space is not in the closed position, the recycling package is transferred upwards by means of a tray part passing through an opening in the bottom plate. The tray part is fixed to a conveyor belt, and the belt is passed over three belt pulleys. By moving the belt, the recycling package is shifted onto two rollers placed side by side adjacent to one another, which are rotated to rotate the package so as read the bar code.

After a central unit has identified the recycling package as either, e.g., a metal container such as an aluminum can or as a plastic container such as a plastic bottle, a receipt or a sum of money corresponding to the identification data is delivered to the person returning the package, and the recycling package is transferred away from the rollers onto troughs passing to the plastic-bottle press or to the can press.

If the package is not identified, it is passed to a rejection system. In this case, the recycling package is brought back to the vicinity of the front panel of the device into a reject opening, from which the returning person can pick up the rejected package. In a preferred embodiment, when a plastic bottle is concerned, the package is shifted to the side off the rollers and through a trough to a plastic-bottle processing device, preferably a crusher device, between whose roll wheels the recycling package is flattened into a smaller volume.

If the central unit has identified the recycling package as an aluminum can on the basis of the bar code that has been read, the can is shifted forward by operating the belt in a direction parallel to the longitudinal axes of the rollers so that the can is moved out of connection with the upper ends of the rollers and into a discharge trough. The can is moved through the discharge trough to a can press device which presses the can and crushes it into a smaller volume.

By means this construction, the device in accordance with the present invention comprises a separate press for recycling cans and a separate press for plastic bottles. The device also comprises one motor which operates both the press drum of the can crusher and at least one of the press drums of the plastic-bottle crusher. Thus, two crusher units are operated by means of a single motor drive.

In the method in accordance with the present invention, the recyclable package is transferred from the receiving space by means of a transfer conveyor which comprises lifting members fixed thereto. The recycling package is placed on the lifting members and carried to an identification position in which the recycling package is identified, e.g., as a plastic container or as a metal container. Based on the identification, the package is directed to a crusher device in which the package is crushed to a smaller volume and passed to a storage container. Otherwise,the package is passed to a rejection system and back to the person attempting to return the package.

In the device in accordance with the invention, the recyclable package is transferred from the receiving space by means of a transfer conveyor passing in proximity to the receiving space. Lifting members on the conveyor extend into the receiving space and contact a bottom surface of the package, and upon movement of the conveyor, lift the package to an identification position in which the recycling package is identified, e.g., as a plastic container or as a metal container. Based on the identification, the package is directed to a crusher device in which the package is crushed to a smaller volume and passed to a storage container.

The present invention will be described in the following with reference to some preferred embodiments of the invention illustrated in the figures in the accompanying drawings. However, the invention is not supposed to be confined to these embodiments alone.

BRIEF DESCRIPTION OF THE DRAWINGS

The following drawings are illustrative of embodiments of the invention and are not meant to limit the scope of the invention as encompassed by the claims.

FIG. 1A is an illustration of a device in accordance with the present invention viewed from the direction of the front panel.

FIG. 1C illustrates the movability of the slide frame R' in relation to the base frame R.

DETAILED DESCRIPTION OF THE INVENTION

FIG. 1A is an axonometric illustration of a device in accordance with the present invention, viewed from outside. The device 10 is suitable for receiving both recycling plastic bottles and recycling cans, preferably aluminum cans, and also glass bottles. The device 10 comprises a receiving space A for the recycling packages, which opens from a plane of the surface of a front panel E of the device into the interior of the device. Front panel Q of the device can be pivoted to the open position on hinge means $G_1$, $G_2$.

Besides the receiving space A, the front panel Q also comprises a reject space T, through which a non-accepted recycling package—a can or a plastic bottle or a glass bottle—can be removed. After all of the person's recycling packages have been fed into the device, the receipt knob $U_1$ is depressed. From a receipt opening $U_2$, a receipt for the recycled number of packages and/or a sum of money corresponding to the packages is/are received, the returned money coming from a money trough $U_3$. By pulling handles $U_4$, the storage containers $S_1$ and $S_2$ for the crushed packages can be pulled out for further transportation.

Figure 1B:
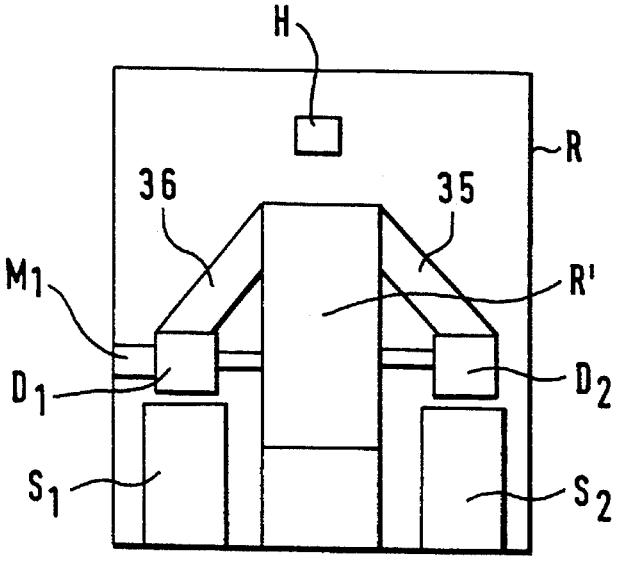
FIG. 1B illustrates the basic constructions of the device in accordance with the present invention.

FIG. 1B illustrates the different parts of the device in accordance with the present invention. The device comprises a crusher $D_1$ provided for cans, a storage container $S_1$ which is placed preferably underneath the press and into which the crushed cans, which have been pressed and crushed into a smaller volume, are gathered. The device also comprises a second crusher $D_2$, preferably a press, by whose means the plastic bottles are crushed into a smaller volume. A storage container $S_2$ for these crushed packages is placed underneath the crusher $D_2$.

The device comprises a slide frame R' displaceably mounted on a frame R and which comprises all substantial means necessary for transferring of the package to be identified by an identification device H. The slide frame R' can be displaced into a forward position when the front panel E of the device is opened. For service operations, there is easy access to all essential parts of the device. The device further comprises a scanner as the identification device H is situated in a position above the slide frame R' so that the bar code is scanned by means of the scanner from the surface of the product.

The slide frame comprises frame parts $R'_a$ and $R'_b$ which define the transfer means in the space between them. The transfer means comprise, e.g., a transfer member that is passed as a closed endless loop, preferably a conveyor belt 16 or, for example, a chain. The transfer loop is passed over guide pulleys. Preferably, there are three guide pulleys and, thus, the transfer member comprises three runs: a first transfer-member run that runs upwardly inclined, a subsequent second, shorter transfer-member run which runs as slightly upwardly inclined in relation to the horizontal plane, and a downward running third run.

The transfer conveyor 16 for transferring the packages is passed as an endless conveyor loop 16' over guide pulleys, such as belt pulleys. The transfer conveyor 16 is preferably a conveyor belt, from which lifting members 19 project outward. The function of the lifting members is to lift the recycling package from the bottom of the receiving space A onto the rotated rollers on which the bar code is read. Since the transfer member is a belt, the guide pulleys are belt pulleys, of which one belt pulley is driven by a motor $M_2$ so as to operate the conveyor belt. The conveyor belt can also be substituted for by a chain or a rope or by equivalent transfer means. In the embodiment wherein the belt is substitutes for by a chain, the belt pulleys are substituted for by chain pulleys. However, it is important that lifting members 19 project from the transfer member so that the recycling package is lifted forwards.

FIG. 1C shows the slide frame R' of the device, which can be displaced in relation to the stationary base frame R of the device.

Figure 1D:
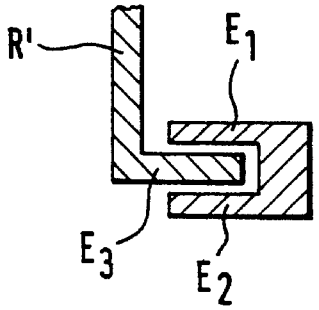
FIG. 1D is a sectional view taken along the line I—I in FIG. 1C.

FIG. 1D is a sectional view taken along the line I—I in FIG. 1C. As shown in FIG. 1D, the slide frame R' is displaced in the direction X (FIG. 1A) in a guide formed between plate parts $E_3$ and $E_2$ of the frame R. Flange part $E_3$ is bent to the side of the slide frame R' and is guided between the plate parts $E_1$ and $E_2$ to enable the slide frame R' to move relative to the frame R.

Figure 1E:
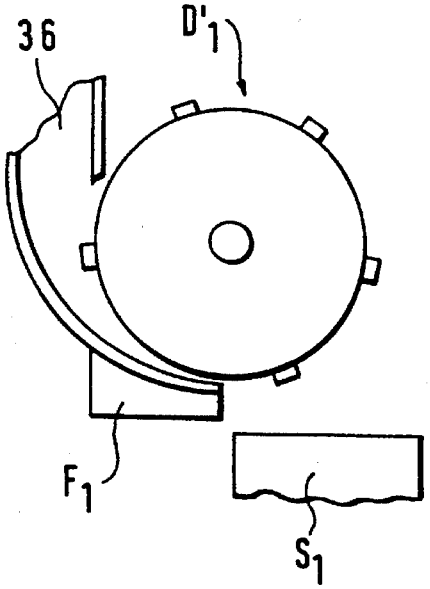
FIG. 1E is an illustration of principle of a crusher device for crushing metal containers such as cans.

FIG. 1E illustrates the principle of operation of the can crusher $D_1$. The crusher D comprises a crusher drum $D_1'$ and a wedge-shaped back-up part $F_1$. When the drum $D_1'$ is rotated, the dropped can P is shifted into a narrowing gap N between the back-up part $F_1$ and the crusher drum $D_1'$ which is rotated by a motor $M_1$. The final result that is obtained is a flattened can which has been crushed and brought into a smaller volume and passed into storage $S_1$.

Figure 1F:
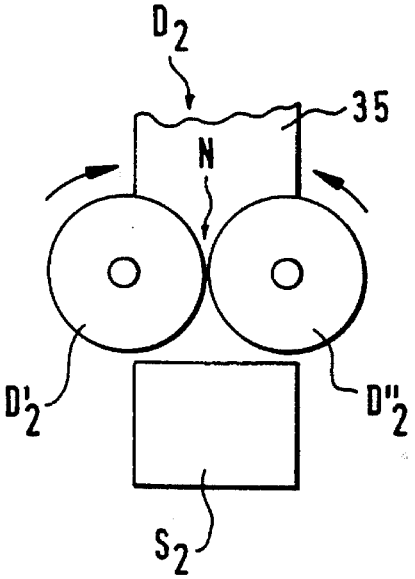
FIG. 1F is an illustration of principle of a crusher device for crushing plastic containers such as plastic bottles.

FIG. 1F illustrates the operation of the plastic-bottle crusher device. A recycled bottle P is passed into a gap $N_2$ between crusher drums or press drums $D_2'$, $D_2''$. Both of the crusher drums $D_2'$, $D_2''$ are rotated by means of the same motor $M_1$ which rotates the crusher drum $D_1'$ of the can crusher $D_1$. The final result is a flattened package which is passed into a storage tank $S_2$.

Figure 2:
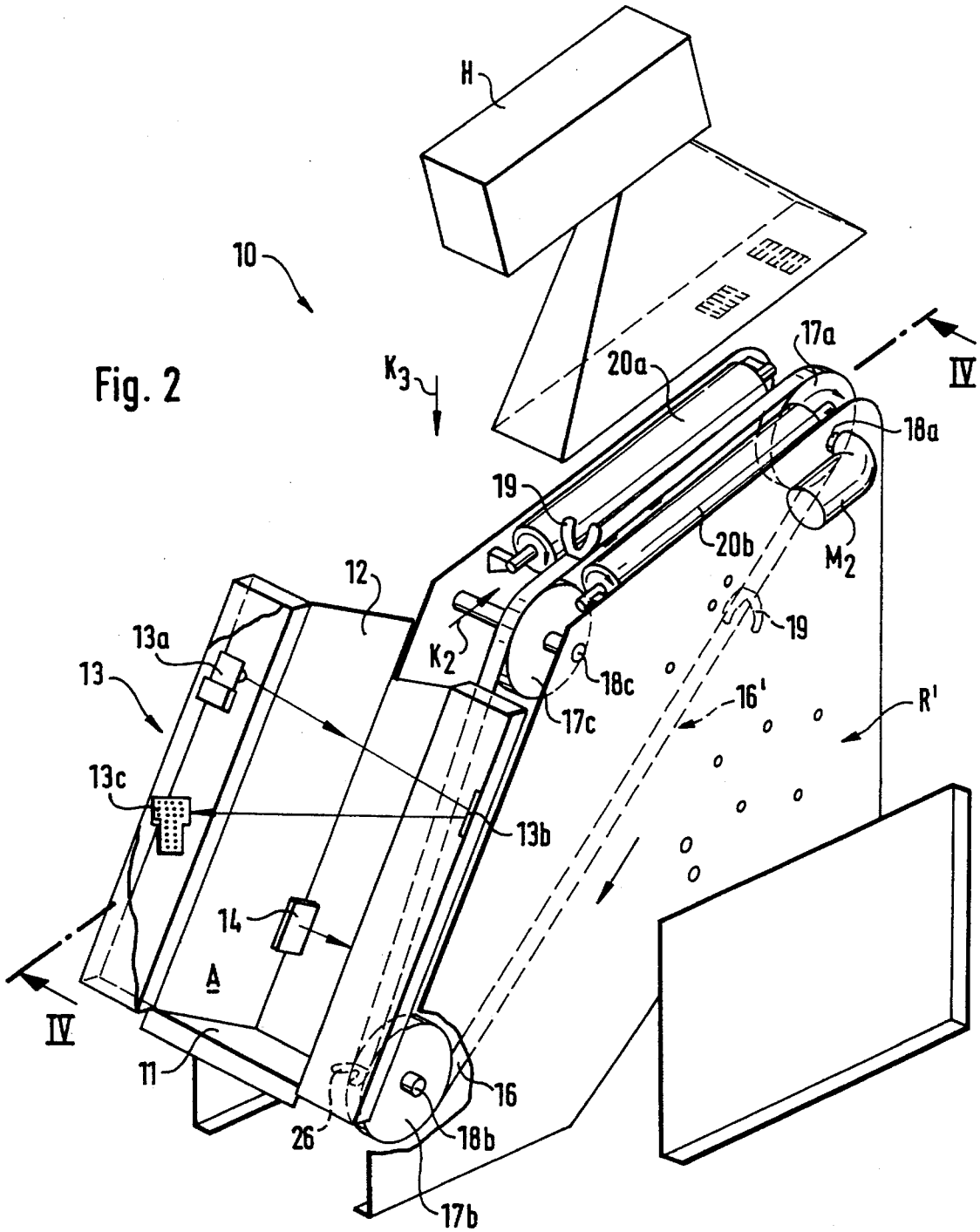
FIG. 2 is an axonometric illustration of the slide frame and of the related means for transferring the package.

FIG. 2 shows the device 10 in accordance with the present invention, in whose slide frame R' the main parts of the device are placed. The device 10 for handling of recycling packages comprises a space A for receiving the packages, which is defined by a bottom part 11 and by side walls 12. In the area of the inlet opening of the receiving space A, there is a light curtain 13 which comprises a transmitter **13*a*, a mirror 13*b*, and a receiving detector 13*c*. A beam of light is emitted from the transmitter 13*a* to the mirror 13*b*, from which it is reflected to the receiving detector 13*c* to be received. By means of the light curtain 13, it is possible to detect if a hand or any other obstacle is present or has been removed from the receiving space A and if the transfer operation of the package can start. The bottom part 11 is inclined to provide a lower end 11*a* onto which the bottle is transferred by the effect of gravity. The device also includes a transmitter 14 and a receiver 15 which monitor and detect if a recycling package P is placed in the transfer position on the end 11*a* of the bottom part 11**.

As shown in FIG. 2, the device further comprises a conveyor band 16, which is passed over three belt pulleys **17*a*, 17*b*and 17*c*. A shaft of belt pulley 17*a* is rotated by means of a motor $M_2$ mounted on the frame R'. The belt pulleys 17*a*, 17*b* and 17*c*** are mounted to revolve on their shafts on bearing means (not shown) in relation to the slide frame R'.

The conveyor belt 16 preferably comprises three trays 19 or lifting members which are arranged to be placed against the bottom of the recycling package. By means of the lifting members, the recycling package is lifted upwards along an inclined path, and further onto rollers **20*a*,20*b*. The rollers 20*a*,20*b* are rotated during the stage of identification of the bar code so that the scanning signal sweeps across the surface of the package P that is rotated by means of the rollers 20*a*,20*b*. One of the rollers, e.g., roller 20*a*, has a drum motor in its interior so that the roller is rotated by means of the drum motor. The rotation is transferred from the roller 20*a* to the roller 20*b* via a slave wheel 21, arranged in engagement and contact with the faces of both of the rollers 20*a*,20*b*. The shafts of the roller 20*a* are denoted by reference numerals 22*a*,22*b* and the shafts of the roller 20*b* are denoted 23*a*, 23*b* reference numerals. The roller 20*a* is articulated by its shafts by bearing means (not shown) on the slide frame R'. In a corresponding manner, the roller 20*b* is mounted on its shafts 23*a*,23*b* to revolve on bearing means (not shown) in relation to the frame R'. The slave wheel 21** is mounted to revolve on its shaft on bearing means (not shown) on the frame R'.

In proximity to the rollers **20*a*,20*b*, there are the walls 24 and 25 having planes parallel to the rollers. Walls 24, 25 are linked so as to pivot on bearing means $G_3$,$G_4$,$G_5$,$G_6$. The walls 24,25 are pivoted by means of an actuator so that it is possible to carry out the sorting from the top of the rollers in the direction $L_2$ shown in FIG. 2. A second function of the walls 24 and 25 is to act as guide walls so as to prevent package from falling off the top of the rotated rollers 20*a*,20*b*** at the scanning stage.

Figure 3A:
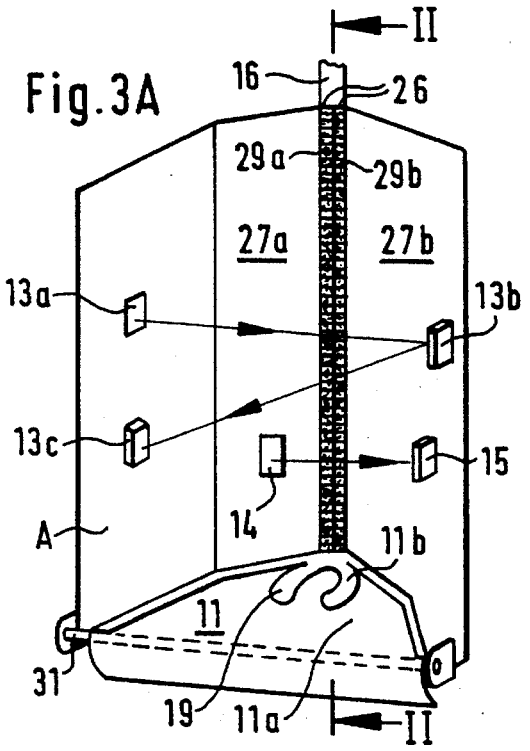
FIG. 3A is an axonometric illustration of the construction of the space for receiving the recycling packages in the device in accordance with the present invention.

FIG. 3A is an illustration of the construction of the package receiving space A. The receiving space for the recycled packages is defined by side walls 12 as well as end walls **27*a*,27*b*. The bottom part 11, which defines the receiving space A from below, comprises an opening 26 which corresponds to the shape of the lifting member or tray 19 fixed to the belt. During operation of the device, the lifting member 19 is shifted through the opening 26 in the bottom part 11** into contact with a bottom surface of the recycling package P.

A gap 28 remains between the end walls **27*a*,27*b*, in which brushes 29*a*,29*b* are arranged. The function of the brushes 29*a*,29*b* is to prevent a free contact between the receiving space and the objects therein and the run of the belt conveyor. However, the brushes 29*a*,29*b* permit a movement of the tray 19 through the gap 28 between the end walls 27*a*,27*b*** in the space A.

The end walls **27*a*,27*b*** are shaped so that only one recycling package at a time can be placed in the space between the end walls.

Figure 3C:
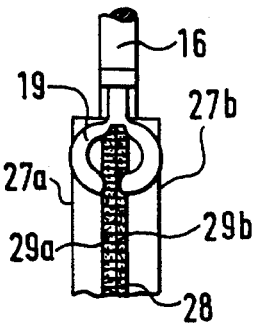
FIG. 3C shows the passage of the tray part fixed to the belt through a gap between end walls of the receiving space through the brush construction arranged the space between the end walls.
Figure 3B:
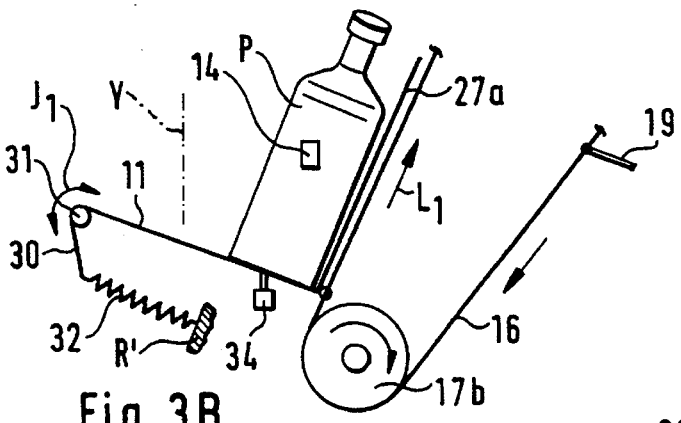
FIG. 3B is a sectional view taken along the line II—II in FIG. 3A showing the manner in which the recycling package is placed on the bottom part of the receiving space, after which the tray fixed to the belt lifts the package in the direction $L_1$.

FIG. 3B is a sectional view taken along the line II—II in FIG. 3A. The recycling package P is placed into the receiving space A on the bottom part 11 which is inclined in relation to a horizontal plane X. The package is placed against the end walls **27*a*,27*b* on the end area 11*a* of the bottom part by the effect of gravity. By means of a detector device, preferably a photocell receiver arrangement 14 or equivalent, the arrival of a package in the lifting position 11*a* is monitored. If a press switch 34 does not go into the closed position and, if it is ascertained by means of a light curtain 13 that the space A is free, the package P is then lifted by means of the lifting member 19 fixed to the belt 16**.

The turning movement of the bottom part 11 is denoted by letter $J_1$. The flap part 30 of the bottom part 11 is provided with a spring 32. The bottom part 11 is linked to pivot on a hinge 31 or equivalent articulated joint means. This structure is applied when the package is too heavy and is to be rejected, i.e., a full package.

FIG. 3C is an axonometric illustration of the brushes **29*a*,29*b* in the space 28 between the walls 27*a*,27*b*. The lifting member 19 is arranged to be displaced vertically. The brush construction, is a security construction, however, and prevents direct unintentional contact between objects in the receiving space and the belt 16**.

Figure 4C:
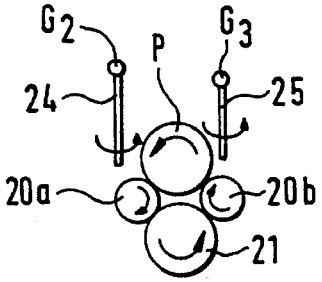
FIG. 4C is an illustration in the direction $K_1$ in FIG. 4B.
Figure 4A:
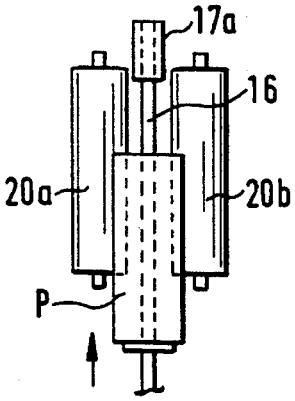
FIG. 4A illustrates the transfer of the package onto the rollers.

FIG. 4A illustrates the transfer of a package by means of the belt 16 and the related lifting member 19 onto the rollers 20*a* and 20*b* to bring the recyclable package to the scanning/identification position.

Figure 4B:
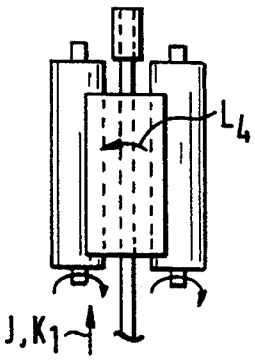
FIG. 4B illustrates the rotation of the package.

FIG. 4B shows a stage in which the rollers 20*a* and 20*b* are rotated in the directions indicated in the figure with arrows so that the package revolves in the direction of rotation indicated by arrow $L_4$ If the rollers 20*a*,20*b* are rotated clockwise, then the package would be rotated counterclockwise. At the scanning identification stage concerned, a scanning beam is passed in the direction parallel to the side line of the package, and the bar code on the package is read. After this, based on the identification data, the central unit of the device carries out the sorting of the recycling package. The ends of the rollers 20*a*,20*b* at the inlet side are positioned lower than the ends of the rollers 20*a*,20*b* at the outlet side. Thus, the rollers are placed in a position inclined from the horizontal plane and inclined upward from the inlet side to the outlet side.

FIG. 4C is an illustration viewed in the direction $K_1$ in FIG. 4B. The roller 20*a* comprises a drum motor. The slave wheel, preferably a friction wheel 21, is pressed by force against the rollers 20*a*,20*b*. When the roller 20*a* is rotated, the other roller 20*b* is thus also rotated by means of the wheel 21, and the direction of rotation at the roller 20*b* is the same as that of roller 20*a*. In FIG. 4C, the directions of rotation are indicated by arrows.

Figure 4D:
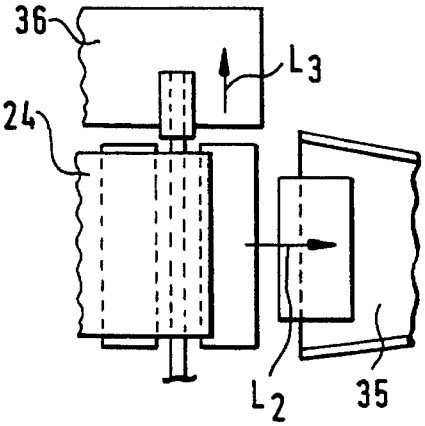
FIG. 4D shows the removal of the recycling package after the rotation, either directly forwards (arrow $L_3$) when shifted by the conveyor, or to the side (arrow $L_2$) when diverted by a pivotal wall.

As shown in FIG. 4D, the recycling package may be shifted in the direction $L_2$, to the side as shown. In this situation, the wall 24 shifts a rejected package and/or an accepted plastic bottle into the first path placed at the side of the device, preferably a trough 35. A rejected package is shifted while the pivotal bottom 45 in the initial part of the trough 35 is in an open position, so that the rejected package falls directly into the return path, preferably a return trough 46, and back to the customer. However, a plastic bottle is passed along the trough 35 to the crusher $D_2$.

If a metal container such as a can is identified as the recyclable package, the can is passed forward by operating the belt 16 and is dropped near the belt pulley 17*a* into the second path, preferably a trough 36, which is placed near the belt pulley. Trough 36 transfers the recycling package to the can crusher device $D_1$.

Figure 5:
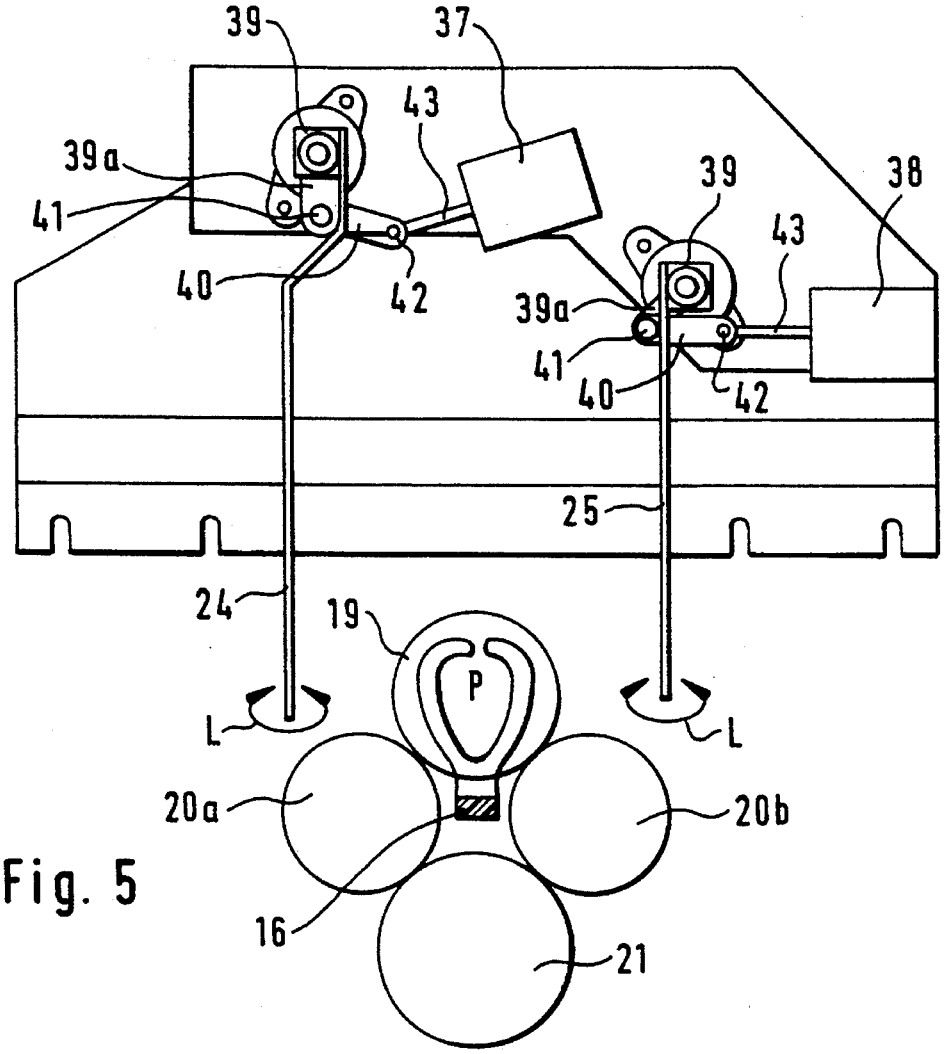
FIG. 5 is an illustration in the direction $K_2$ in FIG. 2 showing an arrangement for removing the recycling package from the revolving rollers to one side of the rollers.

FIG. 5 shows the walls 24 and 25 placed alongside the rollers 20*a*,20*b*, which walls form a protected space therebetween in which the recycling package can be rotated on the rollers 20*a*,20*b*. Thus, before the recycling package is shifted off the rollers by means of the wall part 24 (arrow $L_2$) into the first trough 35 or on the belt into the second trough 36 (arrow $L_3$), the bar code is read from the face of the rotating product. As shown in FIG. 5, the package P is shifted onto the rollers 20*a*,20*b* by means of the thin belt 16 and the related lifting member 19 running in the space between the rollers.

The wall 24 is coupled to a first actuator 37, and the second wall 25 is coupled to a second actuator 38. The actuators 37,38 are preferably solenoids and have a displaceable push arm 43. When a recycling package, such as a rejected can, is shifted in the direction $L_2$, the first wall 24 is pivoted in the direction $L_2$. Before this movement, the second wall 25 is shifted out of the way for the shifting movement of the wall 24, likewise in the direction $L_2$. Thus, when the wall 24 is pivoted and the package is pushed by means of the wall 24 to the side (in the direction $L_2$), the second wall 25 does not stand in the way or impede the shifting movement.

Figure 6:
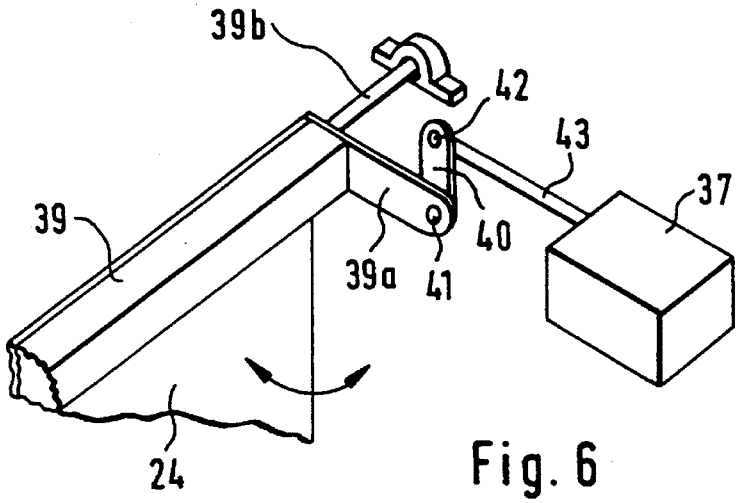
FIG. 6 shows a solenoid mechanism for shifting of the side wall in FIG. 5.

FIG. 6 shows a coupling construction related to the wall 24. The construction is also the same in the coupling between the actuator 38 and the wall 25. In its upper portion, the wall 24 comprises a square-section bar 39 connected to a lever 39*a*. An intermediate lever 40 is connected at one end by an articulated joint 41 with the lever 39*a* and is connected at the opposite end by means of an articulated joint 42 with a push arm 43 of an actuator 37, preferably a solenoid. The square-section bar 39 is provided with a circular shaft 39*b* mounted in a bearing $G_n$. The other end of the square-section bar 39 is also mounted in a similar manner by means of another bearing $G_n$.

Figure 7:
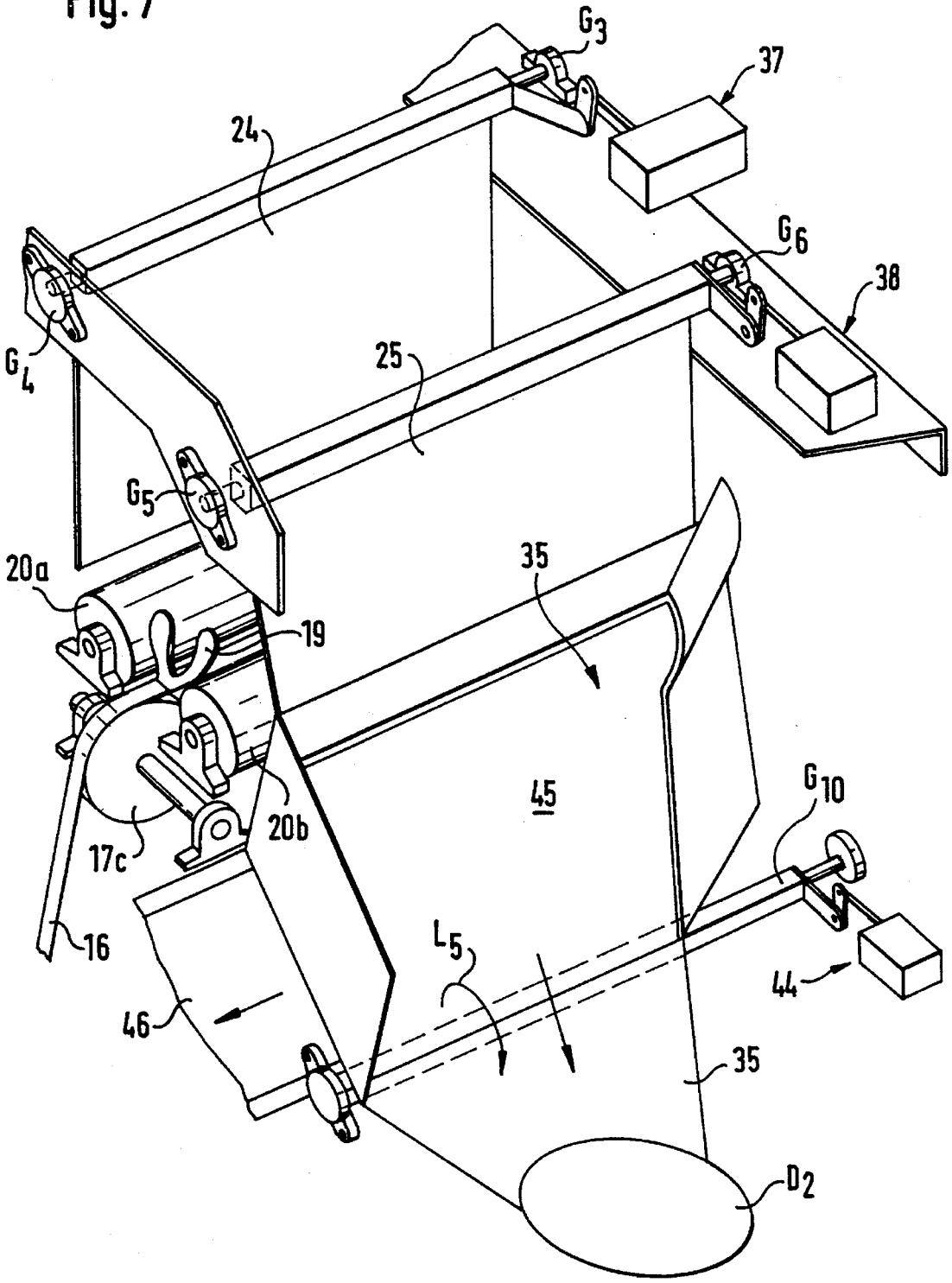
FIG. 7 shows a sorting arrangement related to rejection of a package.

FIG. 7 shows the construction of the recycling trough placed at the side of the rollers 20*a*,20*b*. The recycling trough 35 passes a recycling package that has been dropped off to a side of the rollers 20*a*,20*b* to the plastic-bottle crusher $D_2$. Both rejected packages and identified plastic bottles are passed into the trough part 35. In the case of rejected packages, the bottom part 45 of the path, preferably the trough portion 35, is raised by means of an actuator 44 on hinge means $G_{10}$, and the bottom part is pivoted into a position (arrow $L_5$) in which the recycling package is dropped into a third path 46 placed underneath, preferably a trough, which passes the recycling package into the reject opening T by the force of gravity back to the customer. The pivotal bottom part 45 is provided with a coupling between the plate part and the solenoid similar to that illustrated in FIG. 6.

Figure 8A:
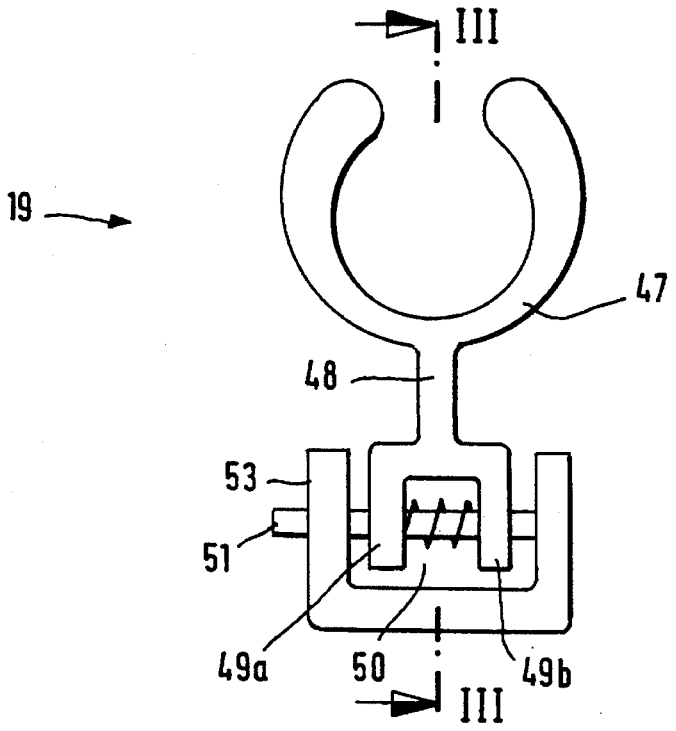
FIG. 8A shows a lifting member fixed to the belt when viewed from above.
Figure 8B:
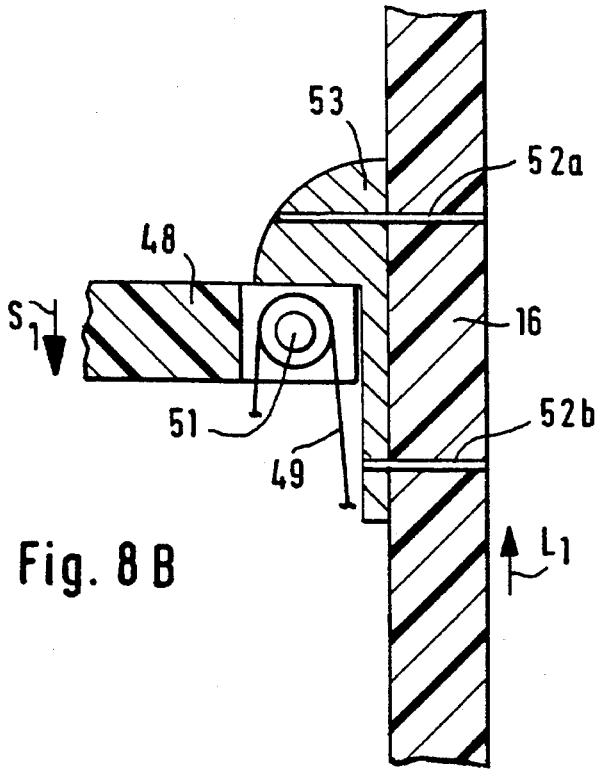
FIG. 8B is a sectional view taken along the line III—III in FIG. 8A.

FIG. 8A shows the lifting member 19 as viewed from above. FIG. 8B is a sectional view taken along the line III—III in FIG. 8A. The construction of the lifting member 19 comprises a grasping part 47 which contacts a bottom surface of the recycling package. The grasping part 47 is connected with an arm 48 which branches into a bracket 49*a*,49*b* between which a spring 50 is arranged. A shaft 51, preferably a cotter pin, is passed through the brackets 49*a*,49*b*. The frame 53 is attached to the belt 16 by means of a collar 52*a*,52*b*. The collar 52*a*,52*b* is passed around the frame 53 and around the belt 16. When the belt is displaced upwards as indicated by arrow $L_1$, the recycling package placed on the lifting member 19 is raised. If the process is congested, the grasping part 47 is bent down as indicated by the arrow $S_1$, and the package is dropped back onto the bottom part 11 to await a subsequent lifting member on the conveyor. The spring 50 returns the grasping part 47 again to its original position after the package has been dropped.

Figure 9:
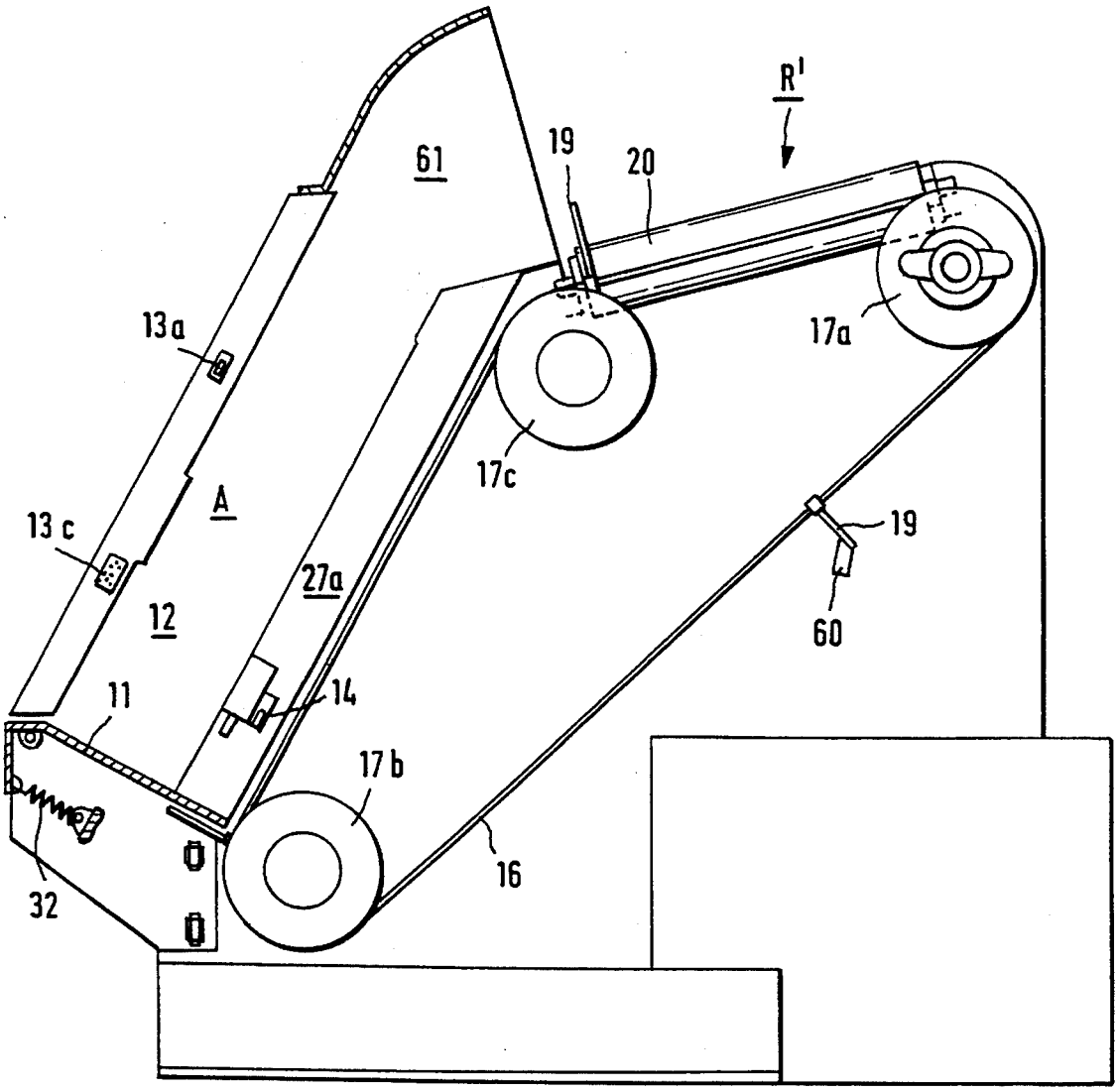
FIG. 9 is a sectional view taken along the plane IV—IV in FIG. 2.

FIG. 9 is a sectional view taken along the plane IV—IV in FIG. 2. The belt 16 is passed over the belt pulleys 17*a*,17*b*,17*c*. The belt pulleys are articulated to revolve on their shafts in relation to the frame R' on bearing means (not shown). The belt 16 comprises three lifting members 19*a*, 19*b*,19*c*. The lifting members are arranged on the belt 16 to be uniformly spaced such that the lifting member 19*a* is placed at the vicinity of the forward end of the roller 20*a*,20*b*, the lifting member 19*b* is placed in a synchronization position in proximity to the detector 60 on the downward belt run, and the lifting member 19*c* is placed in the lifting position in the vicinity of the end 11*a* of the plate 11. Thus, when the belt 16 is at a stop, one lifting member 19 is always placed at a synchronization detector 60 which can also be considered to have a regulation function, i.e., to regulate the position and readiness of the lifting members on the conveyor.

FIG. 9 shows the curved trough-shaped upper portion 61, from which the recycling package is passed to the rollers 20*a*,20*b* when being carried by the belt 16.

Figure 10:
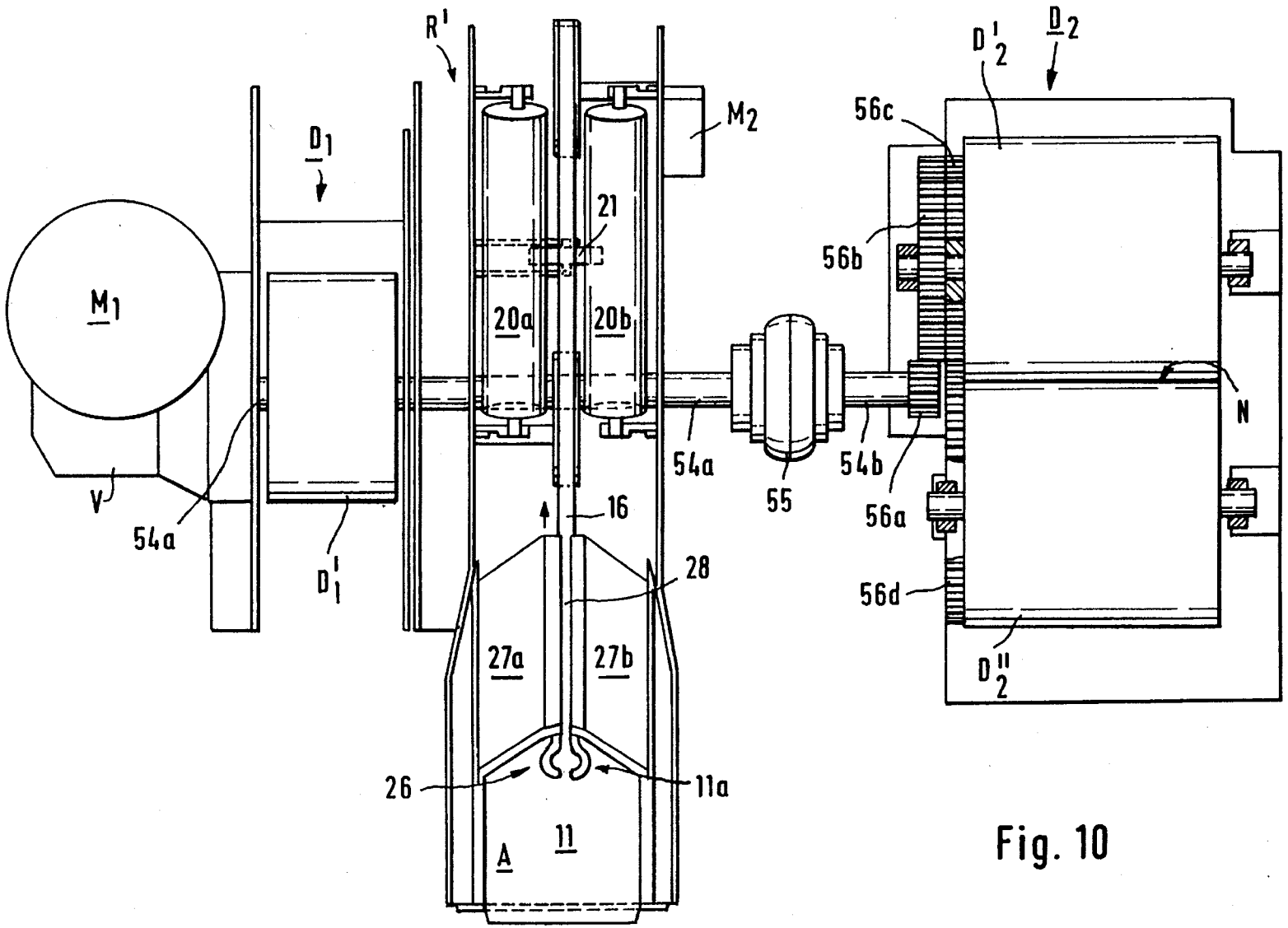
FIG. 10 shows the arrangement of joint operation of a can crusher device and a plastic bottle crusher device seen in the direction of the arrow $K_3$ in FIG. 2, i.e., from above.

FIG. 10 shows the operation of the can crusher $D_1$ and of the plastic-bottle crusher $D_2$. From the motor $M_1$, the motive force or drive is passed through the transmission system V directly to the shaft 54*a* and the press drum $D_1'$ of the can crusher $D_1$. Similarly, by means of a coupling 55, the output shaft 54*a* of the motor $M_1$ directly operates the shaft 54*b*. Further, by means of cogwheels 56*a*,56*b*,56*c*,56*d*, the drums $D_2'$, $D_2''$ of the second crusher $D_2$, provided for plastic bottles, are also operated. Thus, in a favorable way, a drive both of the drum $D_1'$ of the crusher $D_1$ and of the drums $D_2'$, $D_2''$ of the crusher $D_2$ have been achieved by means of the same motor $M_1$.

The examples provided above are not meant to be exclusive. Many other variations of the present invention would be obvious to those skilled in the art, and are contemplated to be within the scope of the appended claims.

I claim:

1. A device for handling recycling packages placed in a receiving space of the device, comprising transfer means for transferring a package from the receiving space to an identification position, said transfer means comprising a conveyor belt and lifting members coupled to said conveyor belt, a pair of rollers, said conveyor belt being directed such that the package is lifted by said lifting members from the receiving Space onto said rollers, identification means for identifying the package when it is situated in said identification position, and crushing means to which the package is directed based on its identification for crushing the package and passing the crushed package to a storage container.

2. The device of claim 1, wherein said transfer means further comprise guide pulleys over which said conveyor belt is passed, and drive means for driving at least one of said guide pulleys to rotate said conveyor such that said lifting members pass through the receiving space into contact with the recycling packages.

3. The device of claim 1, wherein said conveyor is directed in a path having a vertical run on which the recycling package is lifted by said lifting members onto said rollers while said conveyor is arranged to pass between said rollers.

4. The device of claim 1, further comprising a slave wheel contacting both of said rollers, a first one of said rollers comprises a drum motor such that the rotation said drum motor is transferred to a second one of said rollers via said slave wheel.

5. The device of claim 1, wherein the receiving space is defined by end walls having a vertical gap therebetween, said lifting members being passed through said vertical gap and into the receiving space.

6. The device of claim 5, further comprising a bottom part defining a bottom wall of the receiving space, said bottom part being arranged at an oblique angle in relation to a horizontal plane such that the package placed onto said bottom part is shifted by gravity to one end of said bottom part in proximity to said vertical gap between said end walls.

7. The device of claim 1, further comprising a bottom part having an opening therein and defining a bottom wall of the receiving space, said lifting members being directed into contact with a bottom surface of the recycling package through said opening in said bottom part during the transfer of the package from the receiving space to the identification position.

8. The device of claim 7, further comprising detector means for detecting the presence of the package in the receiving space, said detector means being arranged in proximity to an end of said bottom part.

9. The device of claim 8, wherein said detector means comprises a transmitter for transmitting a beam of light and a receiver for receiving the beam of light.

10. The device of claim 1, further comprising a light curtain arranged in the receiving space in proximity to a front panel of the device, said light curtain detecting the presence of obstacles in the receiving space.

11. The device of claim 1, wherein said lifting members comprise a frame connected to said conveyor, a shaft passing through said frame, an arm having a grasping part on one end and brackets on an opposite end, said brackets being arranged on said shaft, and a spring arranged between said brackets and on said shaft, said spring positioning said grasping part in a lifting position.

12. The device of claim 1, further comprising three lifting members and regulating means to control the position of said three lifting members such that a first one of said lifting members is at an inlet end of said rollers, and a second one of said lifting members is positioned in proximity to a bottom part of the receiving space.

13. The device of claim 1, further comprising a displaceable slide frame on which said transfer means are arranged, and means for guiding and displacing said slide frame in relation to a stationary frame of the device.

14. The device of claim 1 wherein said rollers are elongate, said conveyor belt is directed in a path such that said lifting members extend above and pass between said rollers in a direction from a first, inlet end of said rollers to a second, outlet end of said rollers.

15. The device of claim 14, wherein said first end of said rollers is positioned lower than said second end of said rollers such that said rollers are inclined from a horizontal plane.

16. The device of claim 14, wherein said crushing means comprise first and second crusher devices, further comprising a first trough leading to said first crusher device and arranged in proximity to said second end of said rollers, said path of said conveyor belt being arranged such that said lifting members pass over the entire length of said rollers and carry the package into said first trough, and an actuator for transferring the package from its position on said rollers to a side of said rollers into a second trough leading to said second crusher device.

17. A device for handling recycling packages placed in a receiving space of the device, comprising transfer means for transferring a package from the receiving space to an identification position, said transfer means comprising a conveyor belt and lifting members coupled to said conveyor belt, a bottom part having an opening therein and defining a bottom wall of the receiving space, said lifting members being directed into contact with a bottom surface of the package through said opening in said bottom part during the transfer of the package from the receiving space to the identification position, detector means for detecting the presence of the package in the receiving space, said detector means being arranged in proximity to an end of said bottom part, identification means for identifying the package when it is situated in said identification position, and crushing means to which the package is directed based on its identification for crushing the package and passing the crushed package to a storage container.

18. The device of claim 17, wherein said detector means comprises a transmitter for transmitting a beam of light and a receiver for receiving the beam of light.

19. A device for handling recycling packages placed in a receiving space of the device, comprising a front panel through which a package is placed in the receiving space, a light curtain arranged in the receiving space in proximity to said front panel, said light curtain detecting the presence of obstacles in the receiving space, transfer means for transferring the package from the receiving space to an identification position, said transfer means comprising a conveyor belt and lifting members coupled to said conveyor belt, identification means for identifying the package when it is situated in said identification position, and crushing means to which the package is directed based on its identification for crushing the package and passing the crushed package to a storage container.

20. A device for handling recycling packages placed in a receiving space of the device, comprising transfer means for transferring a package from the receiving space to an identification position, said transfer means comprising a conveyor belt and lifting members coupled to said conveyor belt, said lifting members comprising a frame connected to said conveyor, a shaft passing through said frame, an arm having a grasping part on one end and brackets on an opposite end, said brackets being arranged on said shaft, and a spring arranged between said brackets and on said shaft, said spring positioning said grasping part in a lifting position, identification means for identifying the package when it is situated in said identification position, and crushing means to which the package is directed based on its identification for crushing the package and passing the crushed package to a storage container.

21. A device for handling recycling packages placed in a receiving space of the device, said device having a stationary frame, comprising transfer means for transferring a package from the receiving space to an identification position, said transfer means comprising a conveyor belt and lifting members coupled to said conveyor belt, a displaceable slide frame on which said transfer means are arranged, means for guiding and displacing said slide frame in relation to the stationary frame of the device, identification means for identifying the package when it is situated in said identification position, and crushing means to which the package is directed based on its identification for crushing the package and passing the crushed package to a storage container.

* * * * *